United States Patent [19]

Okutomi et al.

[11] 4,345,130

[45] Aug. 17, 1982

[54] ELECTRICAL CONTACT

[75] Inventors: Tsutomu Okutomi, Yokohama; Masachika Iida, Kuwana; Kazuyoshi Kuwabara, Tama; Hisashi Yoshino, Yokohama; Eiichi Takayanagi, Yokosuka, all of Japan

[73] Assignee: Tokyo Shibaura Denki Kabushiki Kaisha, Kawasaki, Japan

[21] Appl. No.: 212,412

[22] Filed: Dec. 3, 1980

[30] Foreign Application Priority Data

Dec. 21, 1979 [JP] Japan ..... 54-165705

[51] Int. Cl.[3] ..... H01H 1/02

[52] U.S. Cl. ..... 200/268; 428/627; 428/673; 428/929

[58] Field of Search ..... 200/268, 269; 428/627, 428/673, 929, 552, 557, 564

[56] References Cited

U.S. PATENT DOCUMENTS

| | | | |
|---|---|---|---|
| 2,504,906 | 4/1950 | Tremblay | 428/673 |
| 3,152,931 | 10/1964 | Kelly | 428/929 |
| 3,373,003 | 3/1968 | Schreiner | 428/929 |
| 3,562,467 | 2/1971 | Mooradian | 200/268 |

FOREIGN PATENT DOCUMENTS

| | | | |
|---|---|---|---|
| 2433788 | 10/1975 | Fed. Rep. of Germany | 200/268 |

*Primary Examiner*—John W. Shepperd

*Attorney, Agent, or Firm*—Schwartz, Jeffery, Schwaab, Mack, Blumenthal & Koch

[57] ABSTRACT

Disclosed is an electrical contact of composite layer type which comprises an interrupting layer consisting of Cu-W alloy, Cu-WC alloy or Cu-W-WC alloy containing 20 to 60 wt % of Cu and being bonded to the top surface of a base plate, and a contacting layer consisting of Ag-WC alloy, Ag-W alloy or Ag-W-WC alloy containing 20 to 60 wt % of Ag and being bonded to the top surface of said interrupting layer.

7 Claims, 1 Drawing Figure

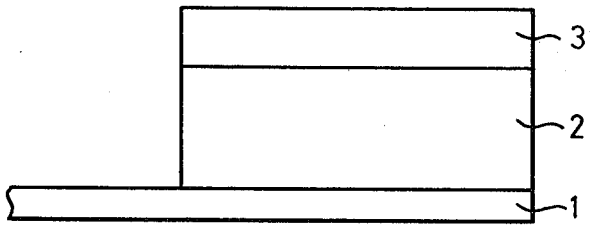
3
2
1

ELECTRICAL CONTACT

This invention relates in general to an electrical contact, and more particularly to an electrical contact which is excellent in contact resistance characteristic, wear resistivity and anti-weld ability.

The most important characteristics required in the electrical contact are anti-weld ability, contact resistance characteristic and wear resistivity. For this reason, it has been attempted to utilize a composition of materials consisting of high melting material such as tungsten(W) or tungsten carbide(WC) and high electroconductive material such as silver(Ag) or copper (Cu), and conventionally, an electrical contact consisting of Ag-WC alloy or Cu-W alloy has been widely employed in a circuit breaker, an electromagnetic switch and the like.

The conventional electrical contact consisting of Ag-WC alloy containing about 60 wt % of Ag is used both for arcing contact and main contact in a middle-load circuit breaker, a contactor or the like, because its contact resistance is low and stable. However, such Ag-WC alloy is known to give little satisfaction to the interrupting duty; in other words, the Ag-WC alloy containing comparatively larger amount of Ag is liable to be damaged when the short-circuit current which is 100 to 1000 times larger than the rated current is interrupted.

The electrical contact consisting of Cu-W alloy containing about 30 wt % of Cu, is not only inexpensive but also has high boiling point and high melting points, and also has a great mechanical strength. Such contact is accordingly excellent in arc erosion resistivity and anti-weld ability, and used, for example, for arcing contact of oil circuit breaker, showing excellent interrupting ability. However, this contact of Cu-W alloy is liable to be very rapidly oxidized at a high temperature and show extremely poor stability of contact resistance.

In view of the problems residing in the conventional electrical contacts as mentioned above, this invention aims to provide an electrical contact of composite layer type, having a stable contact resistance characteristic when the contacting operations are performed under a rated current flow, and at the same time, when the shortcircuit current is interrupted, showing arc erosion resistivity and anti-weld ability and being excellent in the interrupting ability as well as in the wear resistivity.

There have been reported electrical contacts of composite layer type: U.S. Pat. No. 2,281,446 discloses an electrical contact of triple layer type, consisting of a contacting surface layer of silver or silver alloy, an intermediate layer of copper or copper alloy and a base layer of iron or iron alloy. U.S. Pat. No. 2,234,834 discloses an electrical contact of vertically multi-layered type, composed of the strips of good conducting metal such as copper or silver and refractory metal such as tungsten. Japanese Provisional Publication No. 57165/1973 (based on German Application No. P 21 43 844.8) discloses also an electrical contact of composite layer type, consisting of an upper layer of silver-tungsten alloy and a lower layer of copper or silver. These prior arts, however, not only aim to solve the problems entirely different from those which the present invention aims to solve, but also do not teach any specific constitution of the electrical contact as herein below described.

According to the present invention, there is provided an electrical contact which comprises an interrupting layer, which is a lower layer, consisting of Cu-W alloy, Cu-WC alloy or Cu-W-WC alloy containing 20 to 60 wt % of Cu and being bonded to the top surface of a base plate; and a contacting layer, which is an upper layer, consisting of Ag-WC alloy, Ag-W alloy or Ag-W-WC alloy containing 20 to 60 wt % of Ag and being bonded to the top surface of said interrupting layer.

The electrical contact according to the present invention may be used at either side of opposing two contacts or at both sides thereof.

The present invention will be described in more detail with reference to the accompanying drawing, which shows a rough illustration of an embodiment of the electrical contact according to this invention.

In the drawing, numeral 1 designates a base plate of electroconductive metal, numeral 2 is an interrupting layer of Cu-W alloy bonded onto the base plate 1, and numeral 3 is a contacting layer of Ag-WC alloy bonded onto the Cu-W alloy layer 2. Generally, the layer of Cu-W alloy or other Cu-WC or Cu-W-WC alloy of the interrupting layer portion should preferably be about 0.5 to 3.0 mm in thickness; the layer of not more than 0.5 mm in thickness is undesirably liable to melt or disperse due to the heat generated when the short-circuit current is interrupted, with the result that the base plate is exposed, and therefore is not effective enough to exhibit the anti-weld ability; the layer exceeding 3.0 mm in thickness is not economical from the viewpoint of mechanism. The layer of Ag-WC alloy or other Ag-W or Ag-W-WC alloy of the contacting layer portion should also preferably be about 0.5 to 3.0 mm in thickness.

If the electrical contact according to the present invention is employed at one side at least of opposing two contacts, the contacting layer portion consisting of Ag-WC alloy can afford to maintain stable contact resistance characteristic for a long period when the contacting operations are performed under the rated current flow. On the other hand, when the short-circuit current is interrupted, almost all portion of the Ag-WC alloy layer is explosively dispersed and vanished from the contacting surface and therefore the interrupting layer which is of Cu-W alloy layer is exposed; this is because the Ag-WC alloy has no resistivity thereto as already afore-mentioned. Even in this occasion, however, the purpose to protect the circuit can be attained by the excellent arc erosion resistivity and anti-weld ability which are inherant to the Cu-W alloy.

As will be seen from the above, the fundamental feature of the electrical contact according to the present invention exists in that the function of Ag-WC system alloy and the function of Cu-W system alloy have been combined together and utilized.

The Cu contained in the Cu-W alloy, Cu-WC alloy or Cu-W-WC alloy forming the interrupting layer portion should comprise from 20% to 60% by weight. The Cu content of not more than 20% by weight is not preferable because it becomes difficult to apply an ordinary method to the production of a sintered alloy of high density and also because a marked oxidization after the interruption of short-circuit current takes place. The Cu content exceeding 60% by weight is not preferable because the anti-weld ability becomes inferior.

The Ag contained in the Ag-WC alloy, Ag-W alloy or Ag-W-WC alloy forming the contacting layer portion should comprise from 20% to 60% by weight. The Ag content of not more than 20% by weight is not preferable because the contact resistance increases to cause a raise of temperature, and the Ag content exceeding 60% by weight is also not desirable because the anti-weld ability becomes inferior.

The electrical contact according to the present invention can be produced by preparing first the contacting layer portion and the interrupting layer portion separately, and then bonding both of them together. By way of an example, an explanation will be made below as to the case where the contacting layer portion is Ag-WC alloy and the interrupting layer portion is Cu-W alloy:

Powdery Ag and powdery WC are well mixed at a predetermined mixing proportion, compressed under pressure of 2 to 4 t/cm$^2$ and molded to form a Ag-WC alloy. An amount of Ag capable of completely filling the holes remaining in the molded body is placed onto the molded body, and allowed to stand for 1 to 3 hours in an atmosphere of hydrogen and at temperatures of 900° to 1000° C., until the Ag placed on the molded body penetrates thereinto. Cu-W alloy can also be prepared in the almost same manner as above. Both the alloys thus prepared are superposed and subjected to heat treatment for 30 minutes at temperatures of 700° to 900° C. in an atmosphere of hydrogen and are bonded together. The warp caused by the heat treatment is straightened by a mechanical means to obtain an electrical contact.

The present invention will be described further in the following Examples:

EXAMPLE 1

By the method as mentioned above, two pieces of electrical contacts were produced, each being in the shape of frustum of quadrangular pyramid and having the contacting layer consisting of 60% Ag-WC alloy and the interrupting layer consisting of 40% Cu-W alloy. The dimensions of each contact are; top surface 5 mm wide and 14 mm long, bottom surface 8 mm wide and 14 mm long, and 2 mm in thickness (contacting layer 0.5 mm thick and interrupting layer 1.5 mm thick). The electrical contacts thus produced were mounted in a no-fuse circuit breaker (contact-closing force: 2 Kg per each contact; contact-separation force: 2 Kg per each contact), one of which as a stationary contact and the other of which as a movable contact, and a test as explained below was conducted. The test results are shown together.

(1) Contacting operations were performed 50 times at the voltage of 550 V, power-factor of 0.5 and the current of 1350 A.

There was found little damage of the contacts.

The contact resistance was 254 to 300μΩ with respect to the initial value of 280μΩ.

The layer of Ag-WC alloy and the layer of Cu-W alloy remained firmly bonded and no detachment of the layers was found.

(2) Following the above (1), the contacting operations were performed 4000 times at the voltage of 550 V and the current of 225 A.

The contact resistance was 260 to 310μΩ. A stable contact resistance was maintained.

Both the layers were still remained firmly bonded and no detachment of the layers was found.

(3) Following the above (2), the temperature of the contact was measured at the current of 225 A and at the ambient temperature of 30° C.

Temperature of the contact was 49° C.(temperature raise: 19° C.). There was found no problem in the temperature characteristic.

(4) Following the above (3), a short-circuit current of 50 KA was interrupted once and then the circuit was caused to close and open once.

The contacting layers of Ag-WC alloy were dispersed and vanished with a little portions thereof remained undispersed here and there. No weld of the contacts, however, was found.

There was shown an excellent interrupting ability.

(5) For comparison, produced were electrical contacts each having the upper layer consisting of 60% Ag-WC alloy and the lower layer consisting of brass. The same test as in the above (4) was conducted to obtain the result that the upper layers which are 60% Ag-WC alloy layers were dispersed and vanished, and at the same time there was found a strong weld of the contacts.

EXAMPLES 2 TO 9 AND COMPARATIVE EXAMPLES 1 TO 7

In the same shape and dimensions as in the case of Example 1, produced were electrical contacts formed by bonding the contacting layers or upper layers and the interrupting layers or lower layers both consisting of the materials as shown in the following Table 1. The electrical contacts thus produced were mounted in no-fuse circuit breakers to make tests for observing the contact resistance characteristics, temperature characteristics, and the interrupting abilities in the same manner as in Example 1 under the conditions as set forth in Table 1. The test results are also shown together.

TABLE 1

| | Constitution of contact (wt %) | | | | | | Contact resistance (μΩ) Performing the contacting operation 4000 times under 550V × 225A | | Raise of temperature (°C.) Continuous current-on under 550V × 225A (Saturated value) | After interruption (50 KA) | |
|---|---|---|---|---|---|---|---|---|---|---|---|
| | Contacting or upper layer | | | Interrupting or lower layer | | | Before operation | After operation | | Observation | Separation force for welded contact (Kg) |
| | Ag | WC | W | Cu | W | WC | | | | | |
| Comparative Example 1 | 15 | 85 | — | 40 | 60 | — | 280–290 | 780–1070 | 45–62 | Surface became extremely rough. | 0 |
| Example 2 | 20 | 80 | — | " | " | — | " | 295–410 | 40–47 | No weld of contacts. | 0 |
| Example 3 | 40 | 60 | — | " | " | — | " | 270–370 | 33–39 | No weld of | 0 |

TABLE 1-continued

| | Constitution of contact (wt %) | | | | | | Contact resistance (μΩ) Performing the contacting operation 4000 times under 550V × 225A | | Raise of temperature (°C.) Continuous current-on under 550V × 225A (Saturated value) | After interruption (50 KA) | |
|---|---|---|---|---|---|---|---|---|---|---|---|
| | Contacting or upper layer | | | Interrupting or lower layer | | | Before operation | After operation | | Observation | Separation force for welded contact (Kg) |
| | Ag | WC | W | Cu | W | WC | | | | | |
| Example 1 | 60 | 40 | — | " | " | — | " | 260–310 | 19–22 | contacts. No weld of contacts. | 0 |
| Comparative Example 2 | 70 | 30 | — | 40 | 60 | — | 280–290 | 260–320 | 19–20 | Great damage found; weld of contacts occurred. | >2 |
| Comparative Example 3 | 80 | 20 | — | " | " | — | " | 250–330 | 19–22 | Great damage found; weld of contacts occurred. | >2 |
| Comparative Example 4 | 60 | 40 | — | 10 | 90 | — | " | 280–330 | 20–24 | Surface oxidized. | 0 |
| Example 4 | " | " | — | 20 | 80 | — | " | " | " | No weld of contacts. | 0 |
| Example 5 | " | " | — | 60 | 40 | — | " | 260–310 | 19–32 | No weld of contacts. | 0 |
| Comparative Example 5 | " | " | — | 90 | 10 | — | " | " | " | Weld of contacts occurred. | >2 |
| Example 6 | 60 | 40 | — | 40 | — | 60 | " | 260–325 | 20–25 | No weld of contacts. | 0 |
| Example 7 | 40 | 60 | — | 40 | 60 | — | 280–290 | 255–300 | 19–22 | No weld of contacts. | 0 |
| Example 8 | " | " | — | 40 | — | 60 | " | 260–315 | 20–23 | No weld of contacts. | 0 |
| Example 9 | 20 | 60 | 20 | 40 | 30 | 30 | " | 260–300 | 20–22 | No weld of contacts. | 0 |
| | | | | Cu | Ag | — | | | | | |
| Comparative Example 6 | 60 | 40 | — | 100 | — | | " | 250–290 | 17–20 | Weld of contacts occurred. | >2 |
| Comparative Example 7 | " | " | — | — | 100 | | " | " | " | Weld of contacts occurred. | >2 |

As apparent from Table 1, the electrical contact having the upper layer of Ag-WC alloy consisting of 15 wt % of Ag(Comparative Example 1) causes abnormal increase of contact resistance and undesirably great rate of the raise of temperature. On the other hand, the ones having Ag content of 70% by weight and 80% by weight, respectively(Comparative Examples 2 and 3), cause great damage and strong weld of contacts after the interruption of short-circuit current. However, the electrical contacts of Ag content of 20 to 60% by weight(Examples 1 to 3 and Examples 6 to 9 as well) show good characteristics in every phase.

Further, the electrical contact having the lower layer of Cu-W alloy containing 10 wt % of Cu(Comparative Example 4) shows a marked oxidization of the surface exposed after the interruption of short-circuit current. The one having Cu content of 90 % by weight(Comparative Example 5) shows the weld at the time of interruption of short-circuit current. The electrical contacts according to Examples 4 and 5 and Examples 6 to 9 as well show good results in every phase, satisfying the function of the lower layer as the interrupting layer.

Comparative Examples 6 and 7 show that the electrical contact having the lower layer of 100 wt % of Cu or Ag causes the weld of contacts at the time of interruption of short-circuit current, and does not play the role of the interrupting layer.

In the above mentioned Examples, the electrical contact of the present invention is used both for stationary contact and movable contact. The equally good anti-weld ability, however, can be also observed when used only for either of them.

We claim:

1. An electrical contact which comprises an interrupting layer for interrupting a large short-circuit current in a circuit breaker consisting essentially of Cu-W alloy, Cu-WC alloy or Cu-W-WC alloy containing 20 to 60 wt % of Cu and being bonded to the top surface of a base plate, and a contacting layer consisting essentially of Ag-WC alloy, Ag-W alloy or Ag-W-WC alloy containing 20 to 60 wt % of Ag and being bonded to the top surface of said interrupting layer.

2. An electrical contact according to claim 1, wherein said interrupting layer consists of Cu-W alloy and said contacting layer consists of Ag-WC alloy.

3. An electrical contact according to claim 1, wherein said interrupting layer consists of Cu-WC alloy and said contacting layer consists of Ag-WC alloy.

4. An electrical contact according to claim 1, wherein said interrupting layer consists of Cu-W alloy and said contacting layer consists of Ag-W alloy.

5. An electrical contact according to claim 1, wherein said interrupting layer consists of Cu-WC alloy and said contacting layer consists of Ag-W alloy.

6. An electrical contact according to claim 1, wherein said interrupting layer consists of Cu-W-WC alloy and said contacting layer consists of Ag-W-WC alloy.

7. In a circuit breaker suitable for interrupting a large short-circuit current and for use as a no-fuse circuit breaker, the improvement comprising an interrupting layer for interrupting a large short-circuit current in a circuit breaker consisting essentially of Cu-W alloy, Cu-WC alloy or Cu-W-WC alloy containing 20 to 60 wt % of Cu and being bonded to the top surface of a base plate, and a contacting layer consisting essentially of Ag-WC alloy, Ag-W alloy or Ag-W-WC alloy containing 20 to 60 wt % of Ag and being bonded to the top surface of said interrupting layer.

* * * * *